US011099515B2

(12) United States Patent
Hayashi

(10) Patent No.: US 11,099,515 B2
(45) Date of Patent: Aug. 24, 2021

(54) IMAGE FORMING APPARATUS WHICH USES A TONER CONTAINING A WAX COMPONENT AND WHICH INCLUDES A CLEANING ROLLER

(71) Applicant: KONICA MINOLTA, INC., Tokyo (JP)

(72) Inventor: Yuji Hayashi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/922,114

(22) Filed: Jul. 7, 2020

(65) Prior Publication Data

US 2021/0048772 A1 Feb. 18, 2021

(30) Foreign Application Priority Data

Aug. 13, 2019 (JP) ..... JP2019-148308

(51) Int. Cl.
*G03G 15/00* (2006.01)
*G03G 21/00* (2006.01)

(52) U.S. Cl.
CPC ..... *G03G 21/0058* (2013.01); *G03G 15/50* (2013.01); *G03G 15/6573* (2013.01); *G03G 2215/00417* (2013.01); *G03G 2215/00708* (2013.01)

(58) Field of Classification Search
CPC ..... G03G 21/0058; G03G 15/50; G03G 15/6573; G03G 15/2021; G03G 2215/00417; G03G 2215/00426; G03G 2215/00708; G03G 2221/0063
See application file for complete search history.

(56) References Cited

U.S. PATENT DOCUMENTS

2005/0196204 A1* 9/2005 Funato ..... G03G 21/206 399/341
2012/0121286 A1* 5/2012 Suzuki ..... G03G 15/6585 399/67
2013/0149000 A1* 6/2013 Sugino ..... G03G 15/2025 399/94
2016/0334749 A1* 11/2016 Iwasaki ..... G03G 15/6573

FOREIGN PATENT DOCUMENTS

JP 2002091205 A 3/2002
JP 2005266079 A * 9/2005

* cited by examiner

*Primary Examiner* — Walter L Lindsay, Jr.
*Assistant Examiner* — Laura Roth
(74) *Attorney, Agent, or Firm* — Holtz, Holtz & Volek PC

(57) ABSTRACT

An image forming apparatus includes: an image former that forms a toner image on paper using a toner containing a wax component; a fixer that fixes the toner image formed on the paper; a cleaner including a cleaning roller that contacts a surface of the paper that has passed through the fixer and causes the wax component to adhere to an outer peripheral surface of the cleaning roller; a cooler that supplies air at least over the outer peripheral surface of the cleaning roller; and a hardware processor that controls operations of the cleaner and the cooler.

11 Claims, 3 Drawing Sheets

IMAGE FORMING APPARATUS WHICH USES A TONER CONTAINING A WAX COMPONENT AND WHICH INCLUDES A CLEANING ROLLER

The entire disclosure of Japanese patent Application No. 2019-148308, filed on Aug. 13, 2019, is incorporated herein by reference in its entirety.

BACKGROUND

Technological Field

The present invention relates to an image forming apparatus.

Description of the Related Art

It has been proposed to use a toner containing a wax component in an electrophotographic image forming apparatus. However, when a toner with a wax component added thereto is used for image formation, the wax component may be melted out during fixing to cause image defect. Therefore, in order to clean the wax component that has melted out on the surface of the paper, a configuration has been proposed in which paper is conveyed for a predetermined distance and cooled to solidify (crystallize) the wax component and clean the wax component by a web (e.g., see JP 2002-91205 A).

However, in the above-described configuration in which the paper is conveyed for a predetermined distance and cooled, a conveyance path for cooling the paper is added to the conveyance path for image formation. The added extension of the conveyance path increases the size of the image forming apparatus.

SUMMARY

To solve the above-mentioned problem, the present invention provides an image forming apparatus capable of cleaning a wax component adhered to paper without extending a conveyance path used for cooling the paper.

To achieve the abovementioned object, according to an aspect of the present invention, an image forming apparatus reflecting one aspect of the present invention comprises: an image former that forms a toner image on paper using a toner containing a wax component; a fixer that fixes the toner image formed on the paper; a cleaner including a cleaning roller that contacts a surface of the paper that has passed through the fixer and causes the wax component to adhere to an outer peripheral surface of the cleaning roller, a cooler that supplies air at least over the outer peripheral surface of the cleaning roller, and a hardware processor that controls operations of the cleaner and the cooler.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

<Image Forming Apparatus>

Hereinafter, an exemplary embodiment of the image forming apparatus is specifically described.

Figure 1:
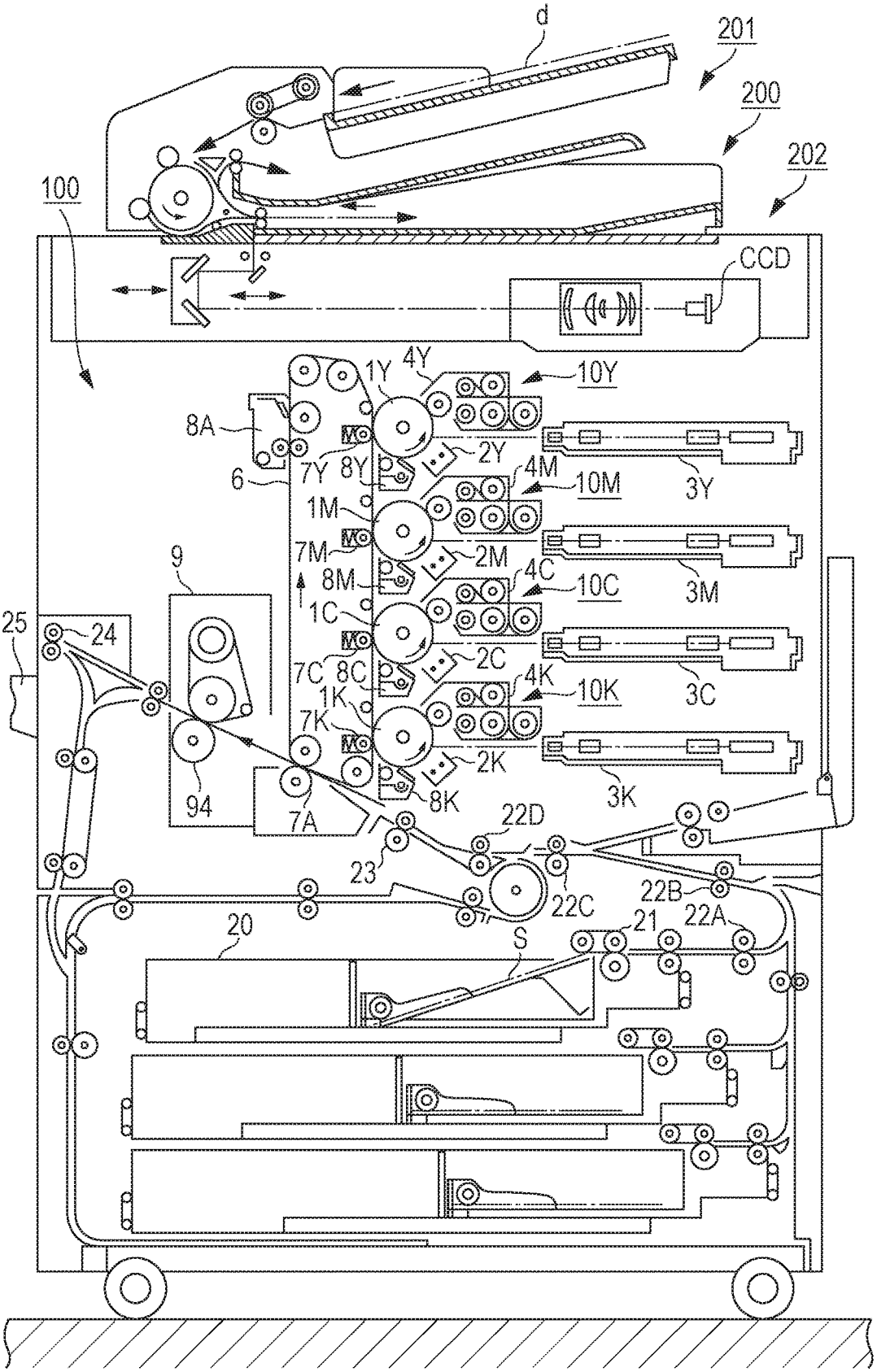
FIG. 1 illustrates a configuration of an image forming apparatus.

FIG. 1 illustrates a schematic configuration of the image forming apparatus. The image forming apparatus illustrated in FIG. 1 includes an image forming apparatus 100 and an image reader 200.

The image forming apparatus 100 is a tandem color image forming apparatus including image formers 10Y, 10M, 10C, and 10K respectively corresponding to yellow (Y), magenta (M), cyan (C), and black (K), an intermediate transfer belt 6, a fixer 9, a cleaner 5, a cooler 30, and the like. The image forming apparatus 100 also includes a control unit (not illustrated) that controls driving of each component of the image forming apparatus 100.

The image reader 200 including an automatic document feeder 201 and a document image scanning and exposure unit 202 is disposed on the upper part of the image forming apparatus 100. In the image reader 200, a document d placed on a document table of the automatic document feeder 201 is conveyed by a conveyance unit, while one side or both sides of the document are scanned and exposed by an optical system of the document image scanning and exposure unit 202 and read by a line image sensor CCD. A signal formed by photoelectric conversion by the line image sensor CCD is subjected to analog processing, analog-to-digital (A/D) conversion, shading correction, image compression processing, and the like in the image processing unit, and then sent to exposure units 3Y, 3M, 3C, and 3K.

The image former 10Y that forms a yellow (Y) color image includes a charging unit 2Y, an exposure unit 3Y, a developing unit 4Y, and a cleaner 8Y around a photosensitive drum 1Y. The image former 10M that forms a magenta (M) color image includes a charging unit 2M, an exposure unit 3M, a developing unit 4M, and a cleaner 8M around a photosensitive drum 1M. The image former 10C that forms a cyan (C) color image includes a charging unit 2C, an exposure unit 3C, a developing unit 4C, and a cleaner 8C around a photosensitive drum 1C. The image former 10K that forms a black (K) color image includes a charging unit 2K, an exposure unit 3K, a developing unit 4K, and a cleaner 8K around a photosensitive drum 1K. The charging unit 2Y and the exposure unit 3Y, the charging unit 2M and the exposure unit 3M, the charging unit 2C and the exposure unit 3C, and the charging unit 2K and the exposure unit 3K each form a latent image former.

The intermediate transfer belt 6 is an endless belt stretching and being rotatably supported over a plurality of rollers to drive the intermediate transfer belt 6. Toner images of the respective colors formed by the image formers 10Y 10M, 10C and 10K are sequentially transferred by the transfer units 7Y, 7M, 7C, and 7K and aligned on the intermediate transfer bet 6 (primary transfer).

A sheet of paper S (hereinafter merely referred to as a sheet S) stored in a paper feed cassette 20 is fed by a paper feed unit 21 and conveyed to a transfer unit 7A via paper feed rollers 22A, 22B, 22C, and 22D, a registration rollers 23, and the like. Then, the color toner image formed on the intermediate transfer belt 6 is transferred to the sheet S (secondary transfer).

The fixer 9 performs fixing processing on the sheet S, on which a color toner image (color image) is formed, by pressurizing and heating the conveyed sheet S to fix the transferred color image onto the sheet S. The sheet S on which the color image has been transferred by the transfer unit 7A is heated and pressed by the fixer 9, and the color image is fixed on the sheet S. After that, the sheet S is sandwiched between paper discharge rollers 24 and put on a paper discharge tray 25 outside the machine.

On the other hand, after the color image is transferred to the sheet S by the transfer unit 7A, a cleaner 8A removes the residual toner from the intermediate transfer belt 6 from which the sheet S has been separated using the curvature of the intermediate transfer belt 6.

The image former described above forms a color image, but the image former may form a monochrome image, or an intermediate transfer belt may or may not be used.

Figure 2:
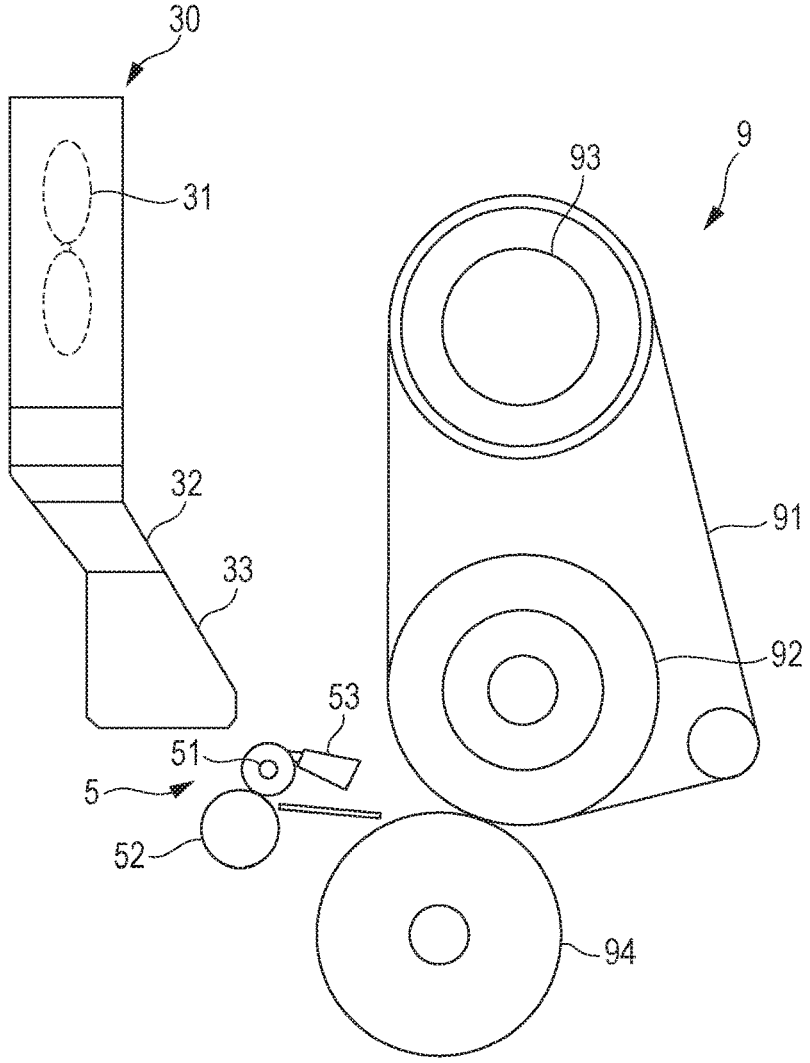
FIG. 2 illustrates a configuration of a fixer, a cleaner, and a cooler of the image forming apparatus.

As illustrated in FIG. 2 which is described later, the cleaner 5 for removing the wax component eluted from the toner to the surface of the paper by fixing is disposed on the downstream side of the fixer 9 in the paper conveyance direction. The cleaner 5 brings the outer peripheral surface of a cleaning roller 51 into contact with the surface of the sheet from which the wax component has been eluted. As a result, the wax component is adhered to the cleaning roller 51, and the wax component on the sheet surface is removed.

The cooler 30 for cooling the cleaner 5 is provided near the cleaner 5. The cooler 30 supplies air around the cleaning roller 51 of the cleaner 5 to cool the outer surface of the cleaning roller 51. As a result, the wax component adhered to the surface of the cleaning roller 51 is solidified and is easily recovered by the cleaner 5.

[Configuration of Fixer and Cleaner]

FIG. 2 illustrates the configuration of the fixer 9 and the cleaner 5 in the image forming apparatus illustrated in FIG. 1.

(Fixer)

The fixer 9 includes a heating roller 93 having a halogen heater or the like built therein, a fixing roller 92, and an endless fixing belt 91 stretching over the fixing roller 92 and the heating roller 93. Further, the fixer 9 includes a pressure roller 94 as a pressure member that presses the fixing member, the pressure roller 94 facing the fixing roller 92 across the paper path via the fixing belt 91. The fixer 9 heats and presses the toner image on the sheet S, on which the toner image has been transferred, while sandwiching and conveying the sheet S in a nip portion formed between the fixing belt 91 and the pressure roller 94.

(Cleaner)

Figure 3:
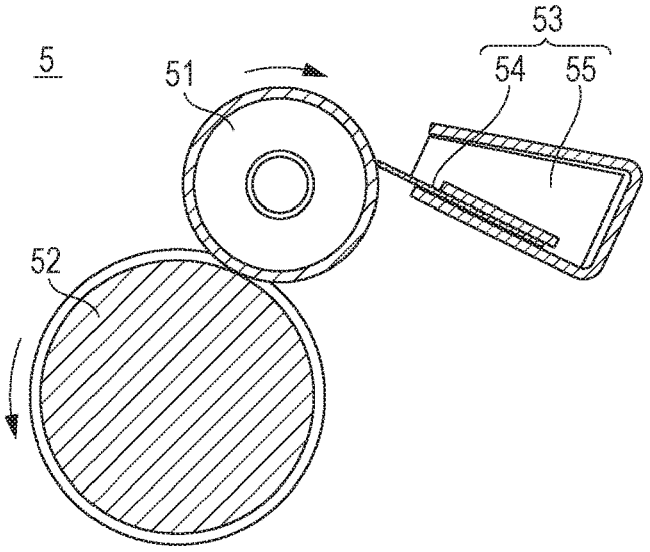
FIG. 3 illustrates a configuration of a cleaner.

As illustrated in FIG. 2, the cleaner 5 is disposed on the downstream side of the fixer 9 in a paper conveyance direction. FIG. 3 illustrates a detailed configuration of the cleaner 5.

The cleaner 5 is disposed on the downstream side of the fixer 9 in the paper conveyance direction. The cleaner 5 includes the cleaning roller 51 that comes into contact with the surface of the sheet S on which the toner is fixed, and a cleaning counter roller 52 that faces the cleaning roller 51 across a paper path. The cleaning roller 51 removes a wax component eluted from the fixed toner on the surface of the sheet S, which has been passed through the fixer 9, from the surface of the sheet S by causing the wax component to adhere to the outer peripheral surface of the roller.

Preferably, in the cleaner 5, the cleaning roller 51 is a member that first contacts the surface of the sheet S after passing through the fixer 9. By disposing the cleaner 5 immediately after the fixer 9, the wax component on the sheet S is not caused to adhere to any component other than the cleaning roller 51 in the image forming apparatus 100.

At least the outer peripheral surface of the cleaning roller 51 includes a resin or a metal to which the wax component can easily adhere (high affinity). Preferably the outer peripheral surface of the cleaning roller 51 includes a metal in terms of the high affinity with the wax component. In particular, the metal preferably includes stainless steel (SUS), aluminum, copper, titanium, and the like.

The cleaning counter roller 52 can be formed by a common driven roller. The cleaning counter roller 52 includes, for example, a cored bar made of stainless steel or the like in a cylindrical shape, and an elastic layer made of foam such as silicone rubber that covers the outer peripheral surface of the cored bar. The cleaning counter roller 52 also includes a release layer formed by a perfluoroalcoxyalcane (PFA) tube or the like to cover the outer peripheral surface of the elastic layer.

The cleaning roller 51 and the cleaning counter roller 52 are provided such that a length of a portion capable of contacting the sheet S in the direction perpendicular to the paper conveyance direction (hereinafter referred to as the "width direction") is equal to or larger than the maximum image area of the image forming apparatus 100. By providing the cleaning roller 51 and the cleaning counter roller 52 over the width equal to or wider than the maximum image area, the wax component can be removed for the sheet S of all sizes on which the image can be formed.

Further, the cleaning roller 51 and the cleaning counter roller 52 preferably have different rigidities on the outer peripheral surface. When the rollers have different rigidities on the outer peripheral surface, one roller is deformed at the nip portion and increases the nip portion area, so that the contact area between the sheet S and the cleaning roller 51 can increase. As a result, the ability of the cleaner 5 to remove the wax component is easily improved.

The cleaner 5 also includes a recoverer 53 for recovering the wax component adhered to the surface of the cleaning roller 51. The recoverer 53 includes a blade 54 and a recovery container 55. One end of the blade 54 contacts the outer peripheral surface of the cleaning roller 51, and the blade 54 scrapes off the wax component adhered to the outer peripheral surface of the cleaning roller 51. The recovery container 55 recovers the wax component scraped by the blade 54 into the container.

Preferably, the blade 54 is installed such that the end contacting the cleaning roller 51 is disposed in a counter direction relative to the rotating direction of the cleaning roller 51 indicated by the arrow. Installed in this way, the ability to scrape the wax component from the cleaning roller 51 is easily improved.

The blade 54 is not particularly limited in shape and material as long as the ability to remove the wax component from the cleaning roller 51 is provided. A material for forming the blade 54 is, for example, a resin such as polyethylene terephthalate (PET) resin or polyphenylene sulfide (PPS) resin, or a metal such as stainless steel (SUS). Preferably, the material of the blade 54 is SUS or PPS resin in terms of durability, and PPS resin is particularly preferable in terms of cost.

Since the wax component recovered in the recoverer 53 is not discharged as much as the waste toner, it is not necessary to provide a discharge path to the outside of the image forming apparatus 100. Preferably, however, the recoverer 53 includes the recovery container 55 to recover the wax component scraped off by the blade 54. The recovery container 55 is disposed at the end of the blade 54 opposite to the end contacting the cleaning roller 51. The recoverer 53 is inclined, so that the recovery container 55 is located lower than the tip of the blade 54. This allows the wax component scraped off at the end of the blade 54 to be conveyed to the end of the opposite side of the blade 54 and recovered in the recovery container 55.

Preferably, the recovery container 55 is capable of being opened partially with a lid member to take out the recovered wax component. By partially opening the recovery container 55, the wax component in the recovery container 55 can be taken out from the open part. Preferably, the recovery container 55 is detachable from the image forming apparatus 100. By removing the recovery container 55 from the image forming apparatus 100, the user can easily take out the wax component from the recovery container 55.

The cleaner 5 may include a drive unit (not illustrated) for rotationally driving the cleaning roller 51, the drive unit being controllable by the control unit of the image forming apparatus 100. By driving the drive unit by the control unit, the cleaning roller 51 can be rotationally driven when removing the wax component from the sheet S.

Preferably, for example, the control unit drives the cleaning roller 51 rotationally at a linear velocity different from a conveyance speed of the sheet S. In particular, by rotating the cleaning roller 51 at the linear velocity higher than the conveyance speed of the sheet S, the ability of the cleaning roller 51 to remove the wax component can be improved easily.

Further, the control unit may drive the cleaning roller 51 at the same linear velocity as driving the conveyance speed of the sheet S. In this case, the cleaning roller 51 and the cleaning counter roller 52 can be driven as conveyance rollers for the sheet S. The use of the conveyance rollers for the sheet S as the cleaning roller 51 and the cleaning counter roller 52 simplifies the configuration and save space of the image forming apparatus 100.

The control unit may rotationally drive the cleaning roller 51 only at the timing when the sheet S has reached the cleaner 5. In this case, the power consumption of the image forming apparatus 100 can be saved.

Alternatively, the control unit may rotationally drive the cleaning roller 51 in a state where the sheet S has not reached the cleaner 5. For example, no sheet S is present in the cleaner 5 before or after the start of the print job, or during the printing between passing of the sheet S and arrival of the next sheet S. By rotating the cleaning roller 51 in this state, the wax component can be scraped off by the blade 54 without newly causing the wax component to adhere to the cleaning roller 51. As a result, the blade 54 can scrape off the wax component adhered to the surface of the cleaning roller 51 for a longer time, thus keeping the surface of the cleaning roller 51 cleaner and decreasing deterioration of the cleaning ability of the wax component on the surface of the sheet S.

When the rotational driving is performed in a state where the sheet S has not reached the cleaner 5, the cleaning roller 51 is preferably rotated at least once until the next sheet S arrives after the sheet S has passed through the cleaner 5. As a result, the wax component that cannot be removed from the surface of the cleaning roller 51 while the sheet S passes through the cleaner 5 can be removed before the next sheet S arrives.

When the rotational driving of the cleaning roller 51 is performed in a state where the sheet S has not reached the cleaner 5, it is preferable to release the nip between the cleaning roller 51 and the cleaning counter roller 52. For example, the control unit releases the pressure of the cleaning roller 51 on the cleaning counter roller 52 and separates the cleaning roller 51 from the cleaning counter roller 52. This prevents moving of the wax component from the cleaning roller 51 to the surface of the cleaning counter roller 52.

(Cooler)

Immediately after the sheet S has passed through the fixer 9, the wax component eluted from the toner by fixing is in a liquid state on the surface of the sheet S, because the temperature is higher than the melting point. Then, before the wax component is solidified, the liquid wax component is caused to adhere to the cleaning roller 51 to remove the wax component from the sheet S in the cleaner 5. However, in order to remove the wax component adhered to the surface of the cleaning roller 51 with the blade 54 in the cleaner 5, it is preferable to solidify (crystallize) the wax component adhered to the cleaning roller 51. The cleaning roller 51 has an outer peripheral surface made of a material having a high affinity with the liquid wax component so that the wax component can easily be adhered. Even when the wax component which is in the liquid state is recovered by the blade 54, the wax component is often left on the cleaning roller 51 side. Therefore, in order to improve the recovery efficiency of the wax component using the blade 54, the wax component adhered to the cleaning roller 51 is cooled by the cooler 30 and solidified between the sheet S and the blade 54 in the image forming apparatus 100.

As illustrated in FIG. 2, the cooler 30 continuously discharges air blown by a blower fan 31 from an air outlet 33 at the tip through a ventilation pipe 32 and blows the air onto the cleaning roller 51. The cooler 30 has a blower fan 31 connected to a driving unit such as a motor (not illustrated) and is driven to rotate to discharge air to the ventilation pipe 32 side. From the air outlet 33, the air supplied through the ventilation pipe 32 is discharged toward the cleaning roller 51.

The air outlet 33 may directly inject air to the cleaning roller 51, or may be configured to supply air around the cleaning roller 51. For example, the cooler 30 preferably injects air to at least a part between the position where the outer peripheral surface of the cleaning roller 51 contacts the sheet S and the position where the cleaning roller 51 contacts the blade 54.

By supplying air from the cooler 30 to the cleaning roller 51, the outer peripheral surface of the cleaning roller 51 and the wax component adhered to the cleaning roller 51 are cooled. By cooling and solidifying the wax component, the recoverer 53 can easily recover the wax component.

Preferably, the cooler 30 ejects air to the cleaning roller 51 over a width equal to or wider than the maximum image area. Thus, the air can be supplied to the entire surface of the area of the cleaning roller 51 where the wax component is adhered. Therefore, the cooler 30 may include a plurality of blower fans 31 and air outlets 33 according to the length of the cleaning roller 51.

Driving the cooler 30 and supplying the air from the cooler 30 to the cleaning roller 51 are controlled by a control unit included in the image forming apparatus 100. The control unit controls driving the drive unit connected to the blower fan 31 to control blowing of air from the cooler 30. Further, the control unit adjusts the speed of the drive unit connected to the blower fan 31, thereby adjusting the amount of air supplied from the cooler 30 to the cleaning roller 51.

The control unit preferably supplies air from the cooler 30 to the cleaner 5 while the cleaning roller 51 rotates. For example, the cooler 30 preferably supplies air while the cleaning roller 51 removes the wax component from the sheet S that has reached the cleaner 5. It is also preferable that the cooler 30 supplies air to the cleaning roller 51 even when the sheet S has not reached the cleaner 5 during the rotation of the cleaning roller 51 to remove the wax component with the blade 54.

Further, the control unit preferably supplies the air from the cooler 30 to the cleaning roller 51 after the print job is completed. Preferably, the cooling is continued if the blade 54 continuously recovers the wax component from the cleaning roller 51 after the print job is completed.

[Configuration of Control Unit]

Figure 4:
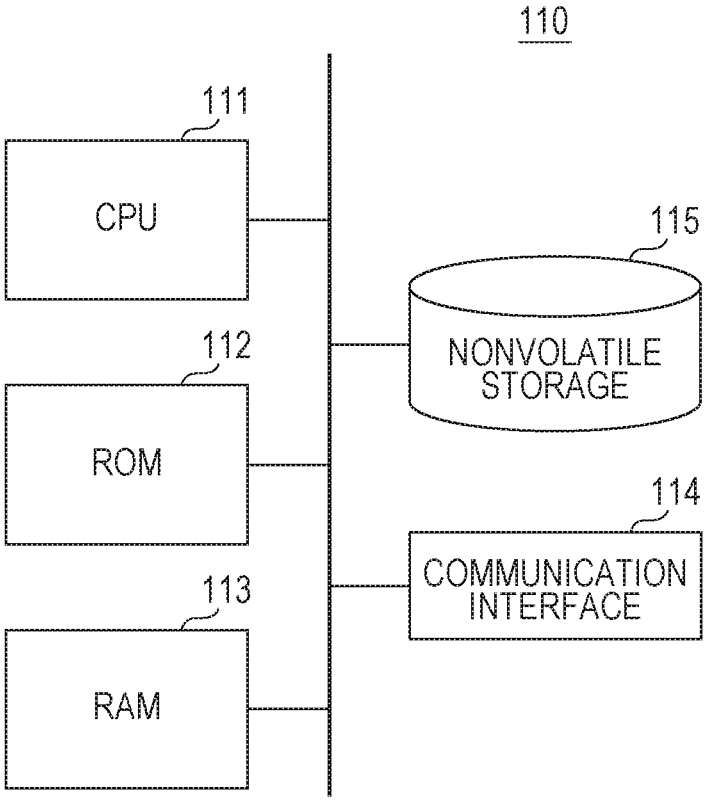
FIG. 4 illustrates a configuration of a control unit.

The configuration of the control unit included in the image forming apparatus 100 is described. FIG. 4 illustrates a block diagram of the internal configuration of the control unit.

The control unit 110 illustrated in FIG. 4 includes a central processing unit (CPU) 111, a read-only memory (ROM) 112, a random access memory (RAM) 113, a nonvolatile storage 115, and a communication interface 114. The control unit 110 is used as an example of a computer that controls each unit in the image forming apparatus 100.

The CPU 111 performs control processing and arithmetic processing in accordance with, for example, an input operation by the user through an operation display unit (not illustrated). The CPU 111 reads out and executes program code of software that realizes individual functions of the present embodiment from the ROM 112 (which is provided as an example of a recording medium). The CPU 111 may be replaced by another arithmetic device such as a micro processing unit (MPU).

The ROM 112 is used as an example of a nonvolatile memory and stores programs, data, and the like necessary for the operation of the CPU 111.

The RAM 113 is used as an example of a volatile memory, and functions as a work area for temporarily storing information (data) necessary for each process performed by the CPU 111.

The nonvolatile storage 115 is an example of a recording medium that stores a program for the CPU 111 to control individual components, a program such as an operating system (OS), and data. For example, the recording unit of the nonvolatile storage 115 records a type, a number, resolution, data size, and a font type of the object of the document data, as well as data size after ripping (RIP) and the like.

The nonvolatile storage 115 may be, for example, a hard disk drive (HDD), a solid state drive (SSD), an optical disk, a magneto-optical disk, a compact disc read-only-memory (CD-ROM), a compact disc recordable (CD-R), a magnetic tape, a nonvolatile memory card, or the like.

The communication interface 114 includes, for example, a network interface card (NIC), a modem, or the like, and establishes a connection with a device of a communication partner via a network such as a LAN, and transmits/receives various data.

The CPU 111 of the image forming apparatus 100 executes the program stored in the ROM 112 or the nonvolatile storage 115 to control the cleaner 5 and the cooler 30 described above.

Although embodiments of the present invention have been described and illustrated in detail, the disclosed embodiments are made for purposes of illustration and example only and not limitation. The scope of the present invention should be interpreted by terms of the appended claims, and various modifications and changes are admitted from the configuration of the present invention.

What is claimed is:

1. An image forming apparatus, comprising:

an image former that forms a toner image on paper using a toner containing a wax component;

a fixer that fixes the toner image formed on the paper;

a cleaner including a cleaning roller that contacts a surface of the paper that has passed through the fixer and causes the wax component to adhere to an outer peripheral surface of the cleaning roller;

a cooler that supplies air at least over the outer peripheral surface of the cleaning roller; and a hardware processor that controls operations of the cleaner and the cooler;

wherein:

the cleaner includes a drive source that rotationally drives the cleaning roller;

the hardware processor activates the drive source to drive the cleaning roller during a print job; and the hardware processor continues driving the cleaning roller and cooling the cleaning roller by the cooler after the print job is completed.

2. The image forming apparatus according to claim 1, wherein the cleaning roller includes a metal on the outer peripheral surface of the cleaning roller.

3. The image forming apparatus according to claim 1, wherein the cleaner includes a cleaning counter roller that faces the cleaning roller across a paper path.

4. The image forming apparatus according to claim 3, wherein the cleaning roller and the cleaning counter roller have different rigidities on the outer peripheral surface.

5. The image forming apparatus according to claim 1, wherein the cleaner includes a recoverer that recovers the wax component from the cleaning roller.

6. The image forming apparatus according to claim 5, wherein the recoverer has a blade that contacts the outer peripheral surface of the cleaning roller.

7. The image forming apparatus according to claim 6, wherein the blade is in contact with the cleaning roller in a counter direction relative to a rotational direction of the cleaning roller.

8. The image forming apparatus according to claim 6, wherein the cooler injects air to at least a part of the outer peripheral surface of the cleaning roller between a position that contacts the paper and a position that contacts the blade.

9. The image forming apparatus according to claim 8, wherein the cooler ejects air to the cleaning roller over a width at least equal to or wider than a maximum image area.

10. The image forming apparatus according to claim 1, wherein the hardware processor drives the cleaning roller at a linear velocity identical to a conveyance speed of the paper.

11. An image forming apparatus, comprising:

an image former that forms a toner image on paper using a toner containing a wax component;

a fixer that fixes the toner image formed on the paper;

a cleaner including a cleaning roller that contacts a surface of the paper that has passed through the fixer and causes the wax component to adhere to an outer peripheral surface of the cleaning roller;

a cooler that supplies air at least over the outer peripheral surface of the cleaning roller; and a hardware processor that controls operations of the cleaner and the cooler;

wherein:

the cleaner includes a drive source that rotationally drives the cleaning roller;

the hardware processor activates the drive source to drive the cleaning roller during a print job; and the hardware processor drives the cleaning roller at a linear velocity different from a conveyance speed of the paper.

* * * * *